US006029294A

United States Patent [19]

Saringer

[11] Patent Number: 6,029,294

[45] Date of Patent: Feb. 29, 2000

[54] MECHANISM FOR GENERATING WAVE MOTION

[75] Inventor: John H. Saringer, Unionville, Canada

[73] Assignee: Saringer Research Inc., Stouffville, Canada

[21] Appl. No.: 09/121,185

[22] Filed: Jul. 23, 1998

[51] Int. Cl.[7] ..... A47B 71/00

[52] U.S. Cl. ..... 5/600; 440/16; 601/53; 5/915

[58] Field of Search ..... 440/16; 601/49, 601/53, 61, 51, 98; 5/600, 915, 610

[56] References Cited

U.S. PATENT DOCUMENTS

| | | | |
|---|---|---|---|
| 3,221,702 | 12/1965 | Clark . | |
| 3,620,651 | 11/1971 | Hugton et al. . | |
| 3,981,612 | 9/1976 | Bunger et al. . | |
| 3,995,972 | 12/1976 | Nassar . | |
| 4,347,036 | 8/1982 | Arnold . | |
| 4,465,941 | 8/1984 | Wilson et al. . | |
| 4,486,145 | 12/1984 | Eldredge et al. . | |
| 4,595,336 | 6/1986 | Grose . | |
| 4,915,584 | 4/1990 | Kashubara . | |
| 4,999,861 | 3/1991 | Huang | 5/600 |
| 5,009,571 | 4/1991 | Smith . | |
| 5,109,558 | 5/1992 | Di Blasi | 5/611 |
| 5,324,169 | 6/1994 | Brown et al. . | |
| 5,626,555 | 5/1997 | Di Blasi et al. | 601/98 |
| 5,708,996 | 1/1998 | Marenco | 5/613 |

FOREIGN PATENT DOCUMENTS

| | | | |
|---|---|---|---|
| 836006 | 3/1952 | Germany | 440/16 |

*Primary Examiner*—Ed Swinehart
*Attorney, Agent, or Firm*—Lynn C. Schumacher; Nancy E. Hill

[57] ABSTRACT

The present invention provides a wave generating apparatus for generating waves in for example beds, chairs and the like. In one aspect the device includes a motor driven crankshaft to which are attached several longitudinal beams. The beams mounted on the crankshafts are offset with respect to each other in such a way as to produce a phase shift between the beams. Each beam is provided with several links pivotally attached at one end to each beam and the links are spaced apart along each beam by a distance equal to the desired wavelength of the wave being produced. The other ends of each link is attached to a flexible membrane which forms a support surface of the bed or chair. The links from the different beams are interleaved at equal phase intervals so as to produce a travelling wave in the flexible membrane so that a complete wave passes during each full rotation of the crankshaft assembly. In another embodiment the motor is replaced by a generator and the mechanical movement of the flexible membrane driven by a fluid for example is converted into other forms of mechanical or electrical power.

28 Claims, 13 Drawing Sheets

MECHANISM FOR GENERATING WAVE MOTION

FIELD OF THE INVENTION

The present invention relates to a mechanism for generating wave motion, and more particularly the invention relates to beds and chairs having wave generating mechanisms incorporated therein.

BACKGROUND OF THE INVENTION

Patients who are immobilized due to partial or complete paralysis, or are recuperating from major surgery or otherwise bedridden for extended periods of time are often unable to exercise or move sufficiently under their own power. In many cases this is problematic and can lead to complications such as bed sores, disuse atrophy of joints and soft tissues. Most solutions to this problem involve changing pressure points exerted on the patient's body by the bed or couch on which they are supported. Mattresses having fluidized beds incorporated into the structure or inflatable/deflatable devices are common but these units typically involve complicated mechanisms and circuitry and are quite expensive. A propagating wave through a mattress support is a desirable alternative to these other solutions.

Several types of wave generating devices have been patented. U.S. Pat. No. 3,981,612 issued to Bunger et al is directed to a wave generating apparatus uses a set of rollers mounted on a carriage that is driven along a set of rails. A flexible sheet is secured at the ends of a frame and as the carriage is driven along the rails the roller displaces the sheet upwardly so that a wave motion is produced along the sheet. This device is quite bulky and is only able to produce one displacement wave for only one set of rollers.

U.S. Pat. No. 4,915,584 issued to Kashubara discloses a device for converting fluid flow into mechanical motion using an airfoil movable within a vertical track. As air flows over the air foil the foil moves vertically up or down in the vertical track thereby transmitting movement to a set of crank arms thereby rotating an axle which is attached at the ends to the two crank arms.

U.S. Pat. No. 4,465,941 issued to Wilson et al is directed to a water engine for converting water flow into other types of mechanical energy. Water flowing toward one side of the device engages a set of butterfly valves and a wheeled carriage is pushed along the frame of the barrage.

U.S. Pat. No. 3,620,651 issued to Hufton discloses a fluid flow apparatus that may operate as a pump or motor. The device includes several flexible sheets driven in oscillatory motion by a bulky crank assembly.

It would therefore be advantageous to provide a compact wave generating device that can be used for producing wave motion for use in chairs, beds or other therapeutic devices or alternatively may be adapted for converting wave motion into other types of mechanical or electrical energy.

SUMMARY OF THE INVENTION

It is an object of the present invention to provide a mechanism that can be adapted for either generating wave motion or converting wave motion into other forms of useful work.

An advantage of the present invention is that it provides an apparatus for generating wave motion that can be adapted for numerous applications including but not limited to wave beds, wave chairs and propulsion systems. The mechanism can also be used generally for converting wave motion into other types of useful work including but not limited to rotary motion and electrical power.

In one aspect of the invention there is provided an apparatus for converting rotary motion into wave motion and vice versa. The apparatus comprises a frame, a crank assembly mounted on the frame with the crank assembly having an axis of rotation and being rotatable about the axis of rotation. The apparatus includes at least two elongate beams, each elongate beam having at least one crank attachment position radially offset from the axis of rotation and being attached to the crank assembly at the crank attachment position. The crank attachment positions on the at least two beams are offset from each other by a preselected angular displacement. When the crank assembly is rotated each beam undergoes oscillatory motion in a plane. Each beam includes at least two link members each pivotally connected at a first end portion thereof to the beam and spaced from each other a preselected distance along the beam. The apparatus includes a planar flexible member with the link members being attached at a second opposed end portion thereof to the planar flexible member. When the crank assembly is rotated travelling waves are produced in the planar flexible member.

In another aspect of the invention there is provided an apparatus for generating power from wave motion. The apparatus comprises a frame, a crank assembly mounted on the frame with the crank assembly having an axis of rotation and being rotatable about the axis of rotation. A generator is connected to the crank assembly. The apparatus includes at least two elongate beams, each elongate beam having at least one crank attachment position radially offset from the axis of rotation and being attached to the crank assembly at the crank attachment position. The crank attachment positions on the at least two beams are offset from each other by a preselected angular displacement. When the crank assembly is rotated each beam undergoes oscillatory motion in a plane. Each beam includes at least two spaced link members each pivotally connected at a first end portion thereof to the beam and being pivotally movable substantially in the plane. The apparatus includes planar flexible support member with the link members being attached at a second opposed end portion thereof to the planar flexible support member. When a force is applied to the flexible support member to produce wave motion in the flexible support member the crank assembly is rotated and the generator is driven.

In another aspect of the invention there is provided an apparatus for converting rotary motion into wave motion and vice versa. The apparatus comprises a frame, a crank assembly mounted on the frame, the crank assembly having an axis of rotation and being rotatable about the axis of rotation. The apparatus includes at least two elongate beams, each elongate beam having at least one crank attachment position radially offset from the axis of rotation and being attached to the crank assembly at the crank attachment position. The crank attachment positions on the at least two beams are offset from each other by a preselected angular displacement, wherein when the crank assembly is rotated each beam undergoes oscillatory motion in a plane. Each beam includes at least two spaced link members each pivotally connected at a first end portion thereof to the beam and being pivotally movable substantially in the plane. Each of the link members having an effective length and the link members on any one beam are positioned relative to the links on all remaining beams in a preselected interleaved spatial configuration. The apparatus includes a planar flexible support member and the link members are attached at a second opposed end portion thereof to the planar flexible support member. When the crank assembly is rotated travelling waves of preselected wavelength and amplitude are produced in the planar flexible support member.

BRIEF DESCRIPTION OF THE DRAWINGS

The following is a description, by way of example only, of an apparatus for generating waves constructed in accordance with the present invention, reference being had to the accompanying drawings, in which:

FIG. 13(*b*) is a side view of another embodiment of a wavegenerating apparatus for producing variable wavelength waves;

FIG. 18(*b*) is a cross sectional view taken along the line 18(*b*)–18(*b*) of FIG. 18(*a*);

FIG. 21(*b*) is a perspective view of the boat and rudder of FIG. 21(*a*).

DETAILED DESCRIPTION OF THE INVENTION

Figure 1:
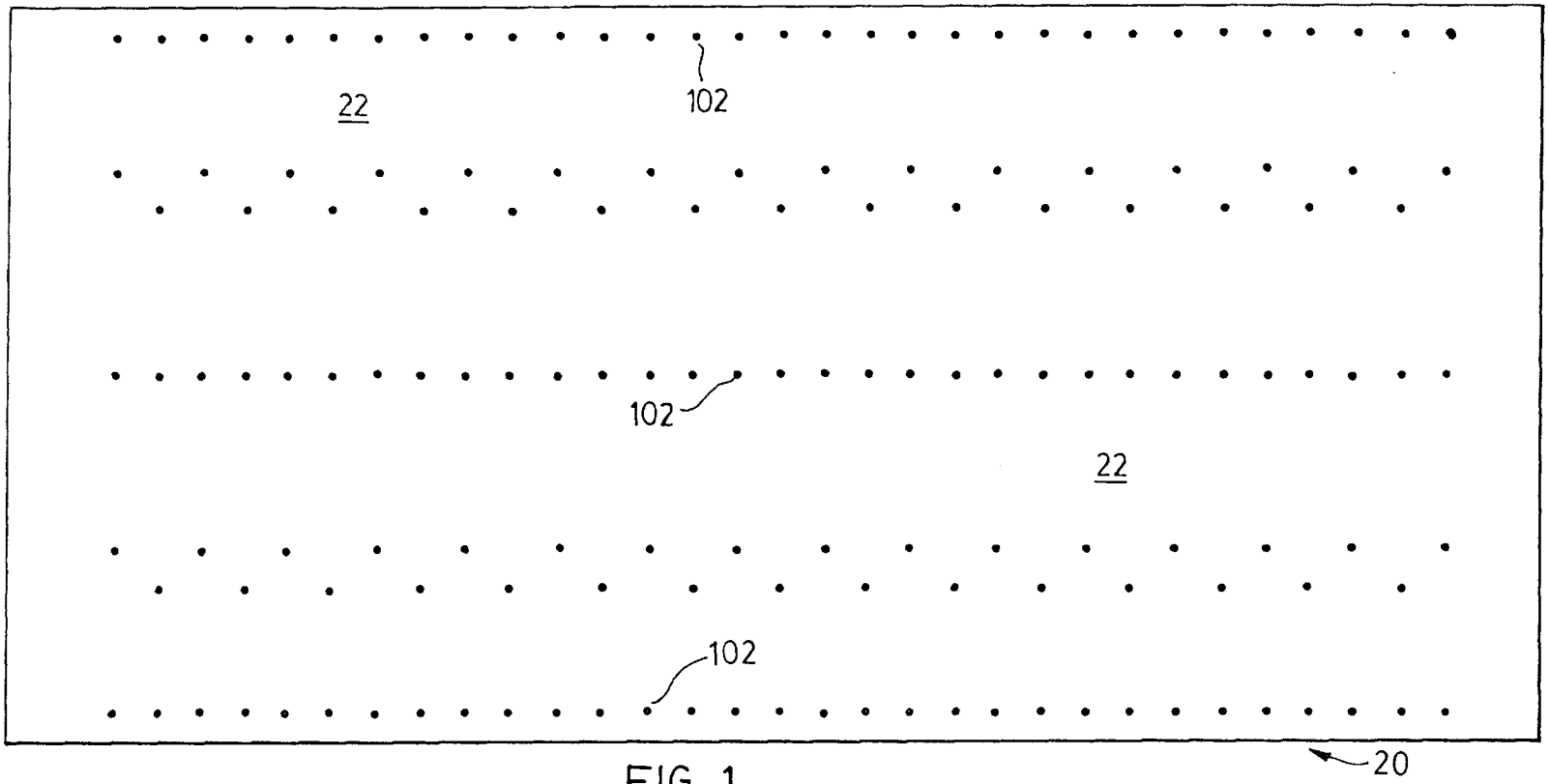
FIG. 1 is a plan view of a bed containing a wave generating apparatus constructed in accordance with the present invention.
Figure 2:
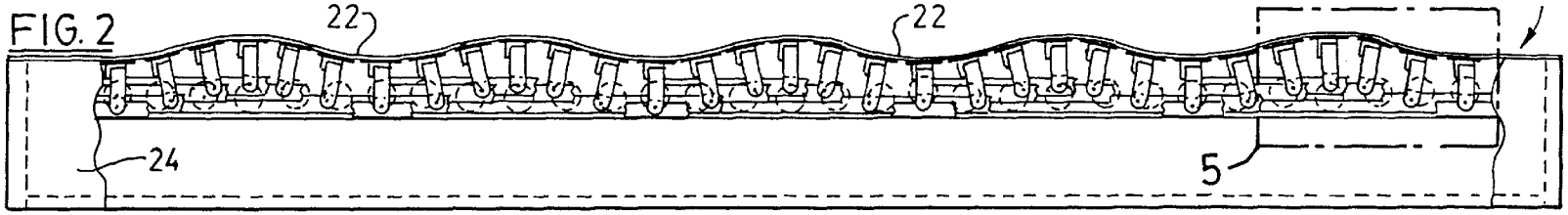
FIG. 2 a side elevation of the bed, shown in FIG. 1, in part section.
Figure 3:
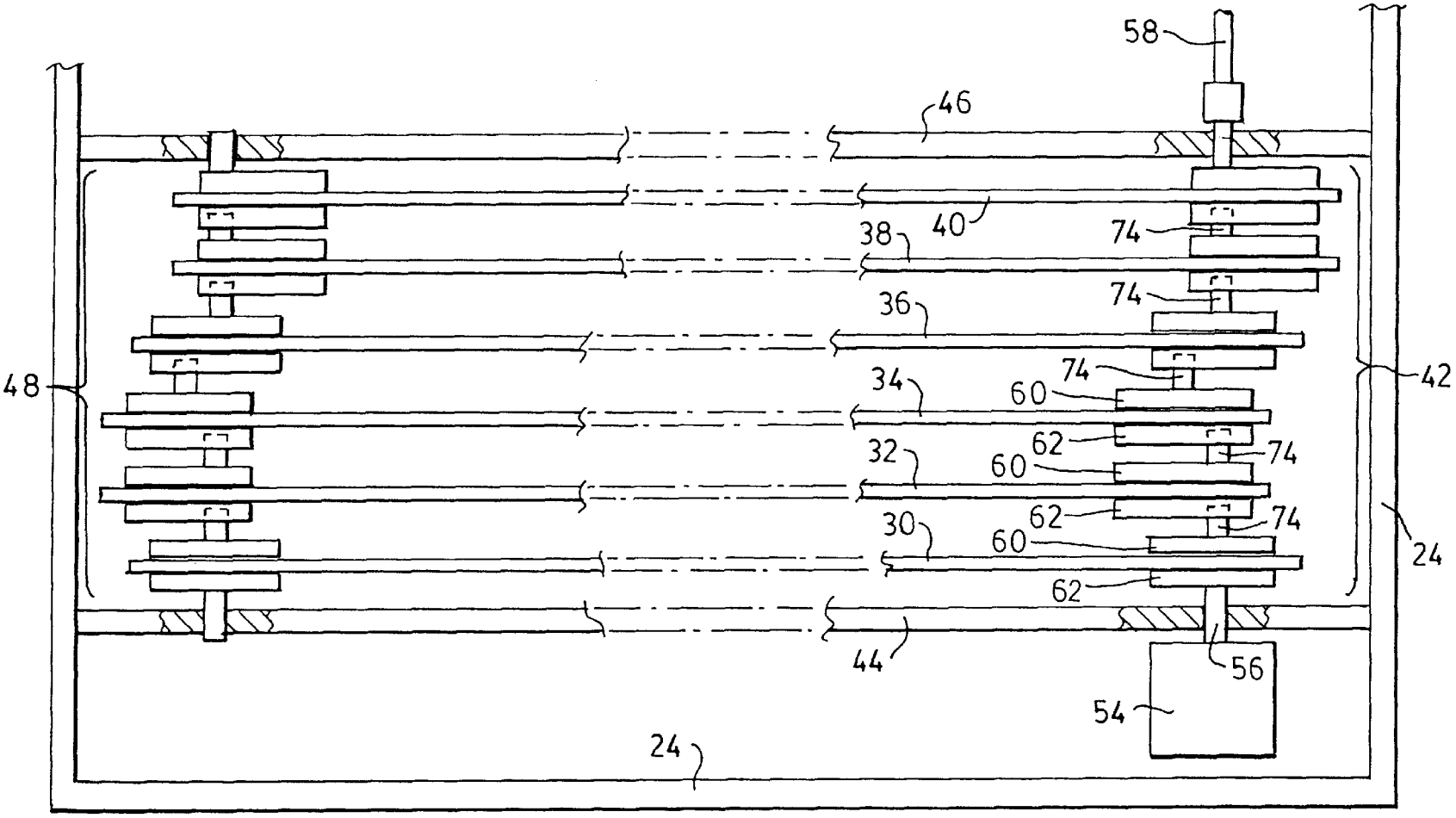
FIG. 3 is an underside view of the links of FIGS. 5 through 10, shown collectively with each arm broken.

Referring first to FIGS. 1 and 2, a wave bed constructed in accordance with the present invention is shown generally at 20. Bed 20 includes a flexible top surface member 22 preferably made of a flexible plastic and a support frame 24 (FIG. 2). Referring to FIG. 3 which shows a portion of the underside of the bed, the wave motion generated in bed 20 is developed using a wave generating apparatus that includes a series of six parallel beams 30, 32, 34, 36, 38 and 40 which are attached at one end of each beam to crankshaft assembly 40 mounted between support rails 44 and 46. The other ends of the beams are connected to an idler crankshaft assembly 48, which is not motor driven, mounted between support rails 44 and 46. A gear motor 54 is attached to crankshaft assembly 42 so that rotational motion of gear motor shaft 56 is converted into both lateral up and down movement of each of the beams as well as angular deflection equal to the tangential slope of the driven wave. It is noted that a motor is not essential in that the shaft could be turned manually to same effect.

An extension shaft 58 is mounted in beam 46 which can be attached to an additional bank of wave generating links. Additional banks of wave generating links can be spread across the width of the bed.

Figure 4:
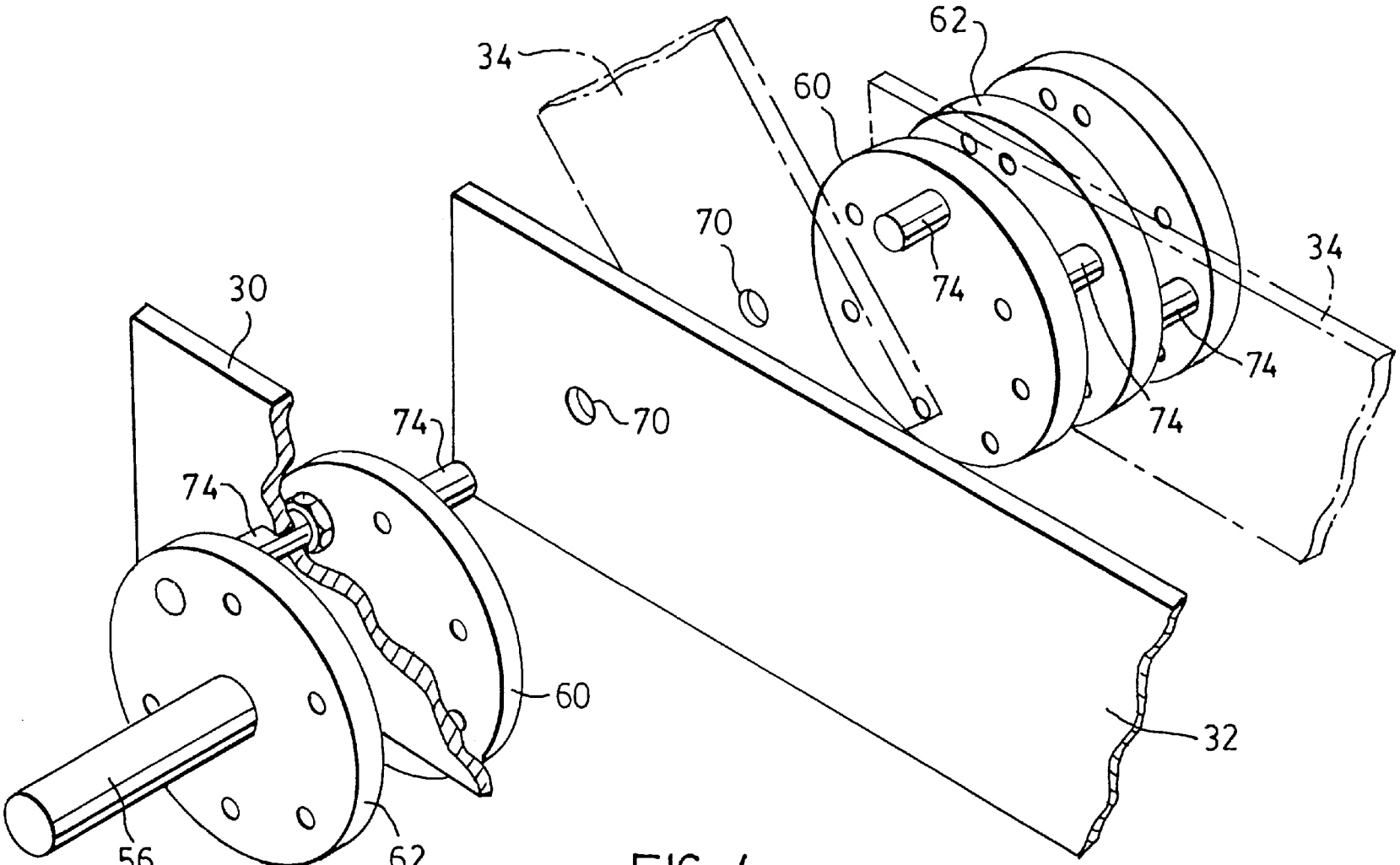
FIG. 4 is a perspective view of a bearing plate exploded from a link arm.

FIG. 4 is a simplified diagrammatic representation of a crankshaft assembly connected to the beams to impart circular motion to the beams which is translated into wave motion along the flexible sheet. A pair of bearing plates 60 and 62 respectively are mounted on either side of each beam, in this case beams 30, 32 and 34. Motor shaft 56 is attached to the centre of plate 62 attached to first beam 30. Each plate 60 and 62 is shown with a hole 68 spaced from the perimeter of each bearing plate. A crank pin 74 is inserted through a hole 70 located in the end portion of each beam and is secured in hole 68 in plate 62 on one side of beam 30 and in a hole 68 in plate 60 on the other side of beam 30. In the representation of FIG. 4 each pair of discs 60 and 62 is connected by a crank pin 74 through hole 70 in the beam do not move with respect to each other. When drive shaft 56 is driven by the motor the discs rotate about the longitudinal axis of shaft 56 and since the crank pins are offset from this axis the beams are driven in a circular path in planes that are perpendicular to the axis of rotation of the crank. The crank assembly is shown assembled with adjacent crank pins spaced 60° apart since there are six beams making up the bank.

The other ends of each beam in the bank of beams are similarly attached to an idler crankshaft assembly 48 with the difference being no motor is provided (FIG. 3). Each of the six beams 30, 32, 34, 36, 38 and 40 has a unique phase so that each beam is 60° out of phase with all the other beam in the bank so the bank of beams defines a total phase difference of 360°. On each beam, the two bearing plates 60 and 62 remain fixed with respect to each other so that when in operation, as shaft 56 is rotated by motor 54, every point on all the beams undergoes circular motion with a 60° phase difference between the beams.

Figure 5:
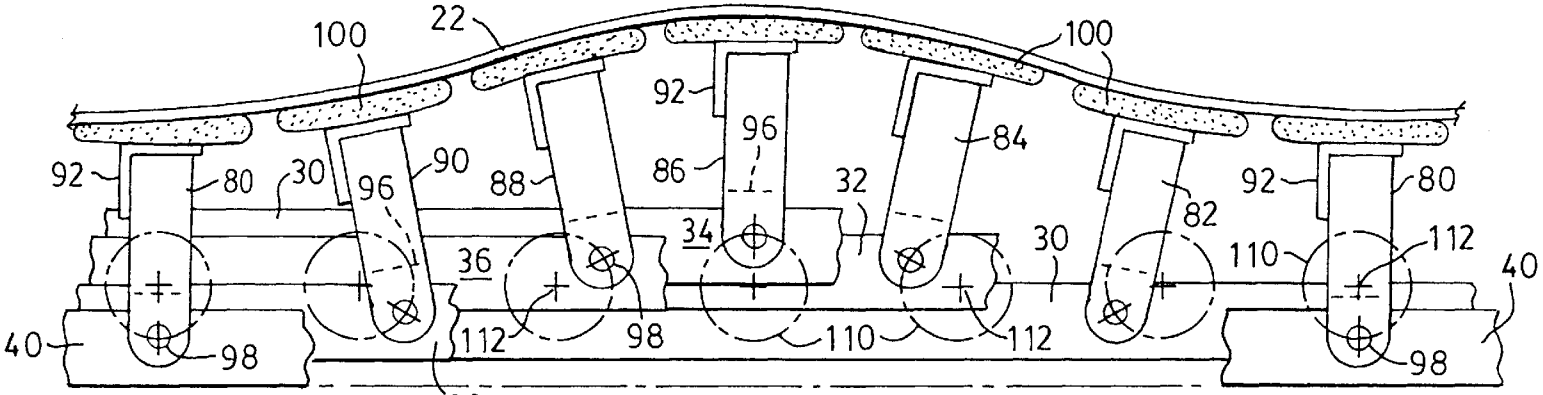
FIG. 5 is an enlarged view of a portion identified as 5 in FIG. 2.
Figure 6:
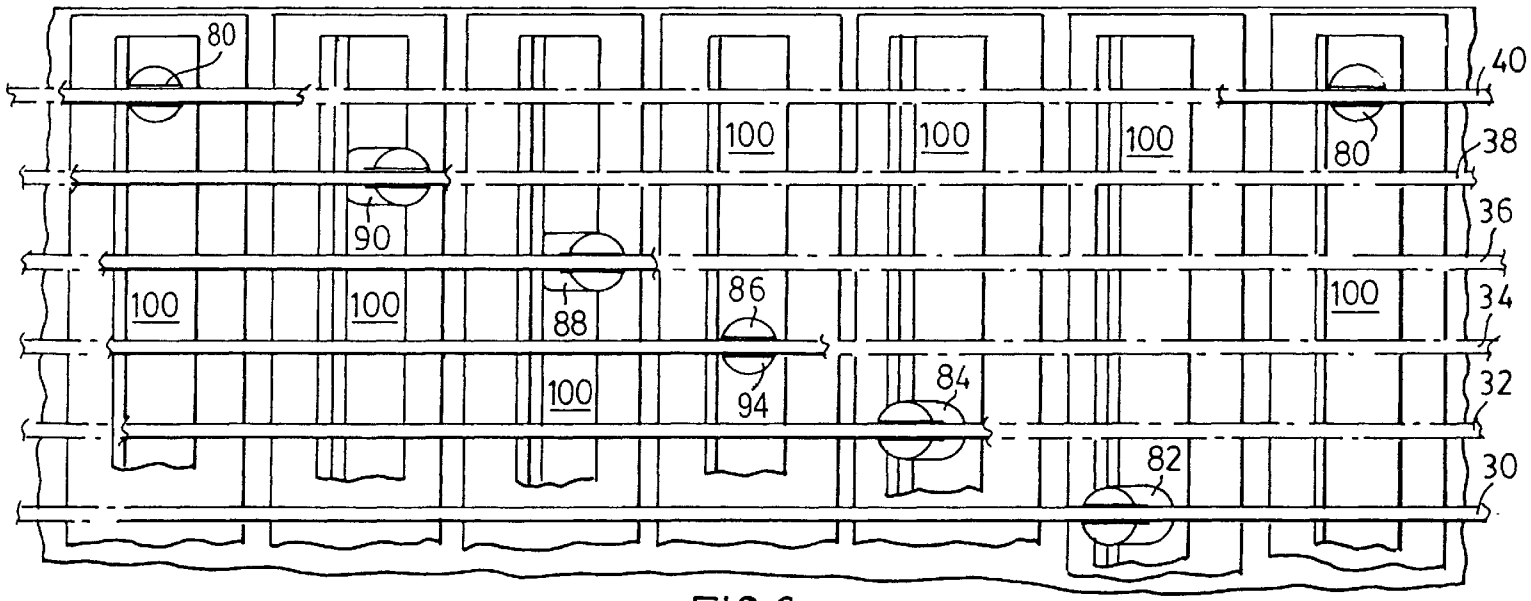
FIG. 6 is an underside view of FIG. 5.
Figure 7:
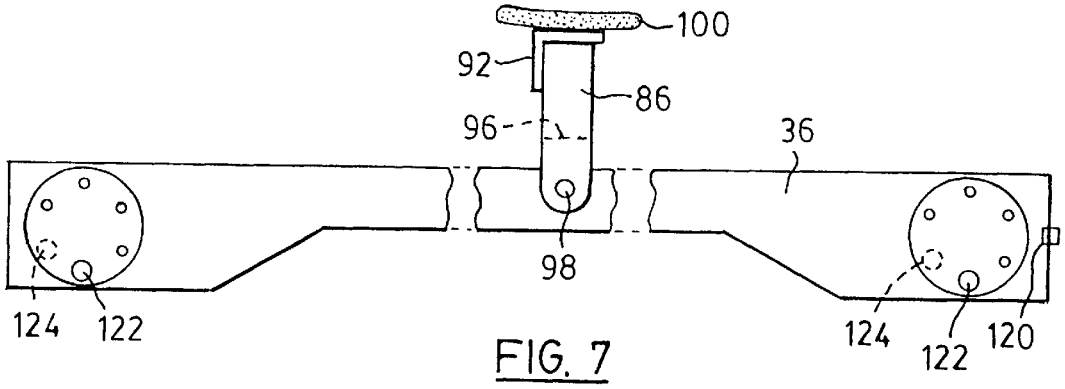
FIGS. 7 to 12 are vertical side elevation views of the link arms shown in FIG. 3 showing one revolution of the present wave generator.
Figure 8:
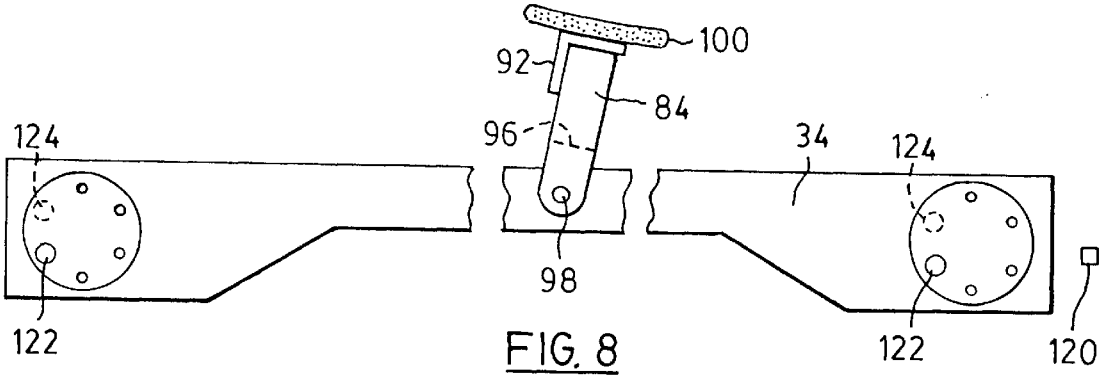
Figure 9:
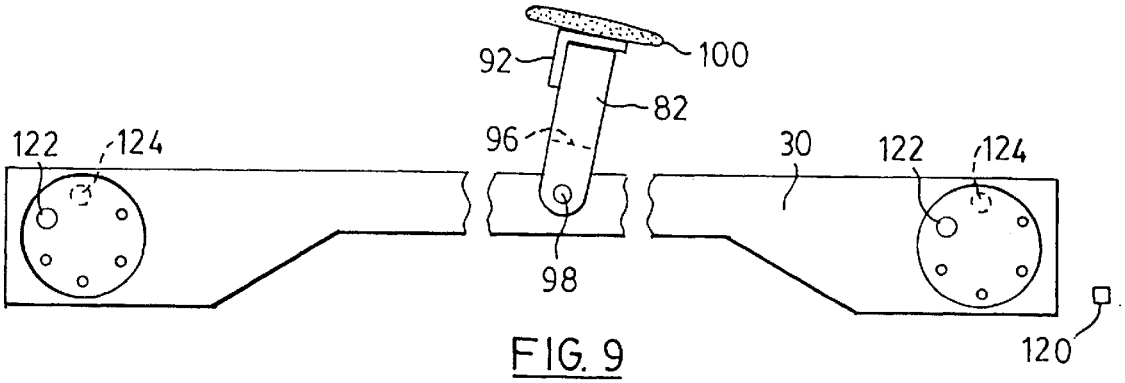
Figure 10:
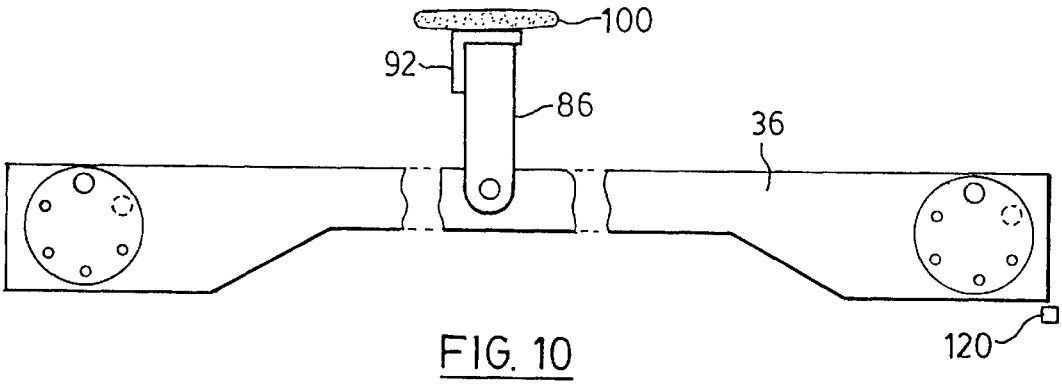
Figure 11:
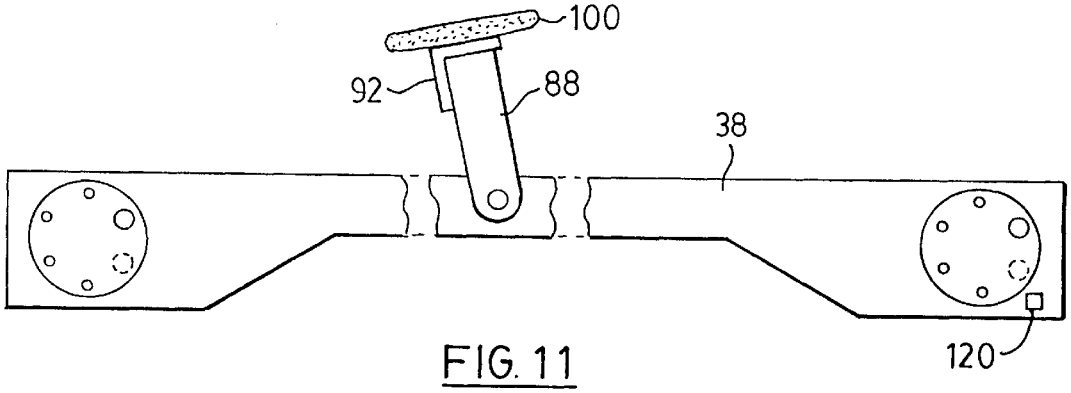
Figure 12:
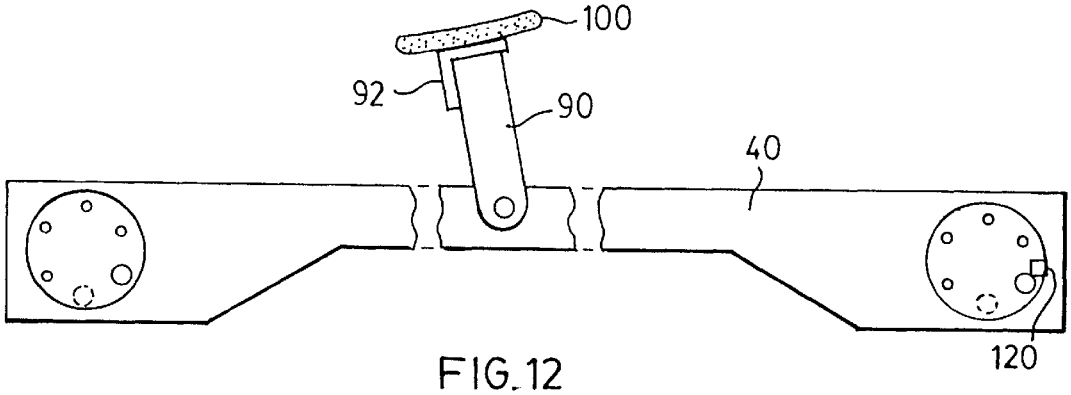

FIG. 5 is an enlarged view of section 5 of FIG. 2 showing seven cylindrically shaped links or drive rods 80, 82, 84, 86, 88, 90 and 80' connected respectively between beams 40, 38, 36, 34, 32, 30 and 40 and the underside of panels 100. These drive rods need not be cylindrical and may be flat if desired. Each of the drive rods is pivotally connected its associated beam for pivotal movement about pivot point 98 and extends away from the beam in the plane in which the beam moves. FIG. 6 shows the underside of this enlarged section of FIG. 5. Each link is connected at one end to a bracket 92 which in turn is connected to the underside of panel 100. Each cylindrical arm is provided with a slot 94 (FIG. 6) at the other end thereof extending up to dotted line 96 (FIG. 5) with the slot being wide enough to receive therein the associated beam. Panels 100 extend transversely across the underside of flexible sheet 22 and the sheet is attached to the panels by rivets 102, best seen in FIG. 1.

Since each point on each beam, regardless of shape, goes through a circular arc in a plane perpendicular to the axis of rotation of the crank, the drive rods 80, 82, 84, 86, 88 and 80' being pivotally attached to each beam, pivot in the same plane in which the beams undergo circular motion. Therefore, because the drive rods are rigidly connected to flexible sheet 22, when the crankshaft is rotated the circular motion of the beams creates a travelling wave along the flexible sheet, see FIG. 2. When the crank is rotated in one direction waves are produced travelling in one direction in the flexible sheet 22 and reversing direction of rotation of the crank assembly reverses direction of the travelling waves.

It will be understood that the idler crank assembly 48 is optional but if present does not need to be located at the other end of the bank of beams. It could be located anywhere along the length of the beams as long as it is spaced from the first crankshaft assembly 42. When the idler crank is present the beams are forced into parallel arrangement so that all parts of the beam undergo circular motion. The motor driven first crank assembly may be positioned where most convenient along the beams.

Those skilled in the art will understand that the basic components of the present apparatus for generating wave motion from rotary motion includes a crank assembly mounted on a support frame, at least two elongate beams attached to the crank assembly with each beam having at least one crank attachment position radially offset from the axis of rotation and being attached to the crank assembly at the crank attachment position. The crank attachment positions are offset from each other by a preselected angular displacement, to give a phase difference between the beams so that when the crank assembly rotates the beams undergo oscillatory movement in a plane substantially perpendicular to the axis of rotation but with the beams out of phase with respect to each other. Each beam includes a minimum of at least two drive rods each pivotally attached at one end thereof to the beam and attached at the other end to a planar flexible sheet. When the crank assembly is rotated each beam undergoes oscillatory motion in a plane substantially perpendicular to the axis of rotation and travelling waves are produced in the flexible sheet.

As mentioned above, when an idler crank assembly is used to constrain the beams the oscillatory motion is pure circular motion. For example, in the case where the beams are unconstrained by an idler crank the motion of the beams is more broadly described as being oscillatory which may include various parts of each beam undergoing circular, reciprocating and/or elliptical motion. For example, in the case where one end of the beams are constrained to undergo reciprocal movement (constrained by a boss in a slot at one end of the beam) the driven crank assembly drives the portion of the beams local to the point of attachment to the crank in a circular path. In this example the constrained ends of the beams undergo reciprocating motion and the unconstrained ends of the beams to undergo elliptical motion in the plane substantially perpendicular to the axis of rotation which produces travelling waves in the flexible sheet.

Travelling waves of variable amplitude across the width of the flexible sheet can be produced by constraining one edge of the sheet running parallel to the length of the beams so the amplitude increases across the width of the sheet. In this case the beams may be pulled and angled slightly from being perpendicular to the axis of rotation.

FIG. 5 illustrates one period of a wave generated by the wave generating apparatus and shows the relative positions of the drive rods 80, 82, 84, 86, 88 and 90. The middle drive rod 86 and the end drive rods 80 are vertical as seen in FIGS. 5 and 6 while the remaining links are at different angles from the vertical, also evident in FIGS. 5 and 6. The links on each separate beam are spaced by a distance equal to the desired wavelength. For example, in FIGS. 5 and 6, the two link members 80 on beam 40 are spaced one wavelength apart. The drive rods from the six different beams are interleaved at equal phase intervals so as to produce a travelling wave in membrane 22 so that a complete wave passes during each full rotation of the crankshaft assembly 42. The broken circles 110 encircling the centre points 112 represent the circular movement defined by the pivot points 98 during operation of the wave generator.

FIGS. 7 to 12 show the individual positions of the different link members in FIGS. 5 and 6 over one wave period. At the right of each drawing is a cross (+) 120 to represent a fixed centre of rotation to which the moving links can be referenced against. The crosses 120 are shown at the same end portion of the bed to which the motor driven crank assembly 42 is located.

In alternative embodiments of the wave generating device different number of beams may be used. For example, when four beams are used to generate the wave motion the studs will be at an angle of 90°. Therefore, it will be understood that the angular displacement is calculated by dividing 360° by the number of desired beams to give the required angular displacement between adjacent beams.

Figure 13A:
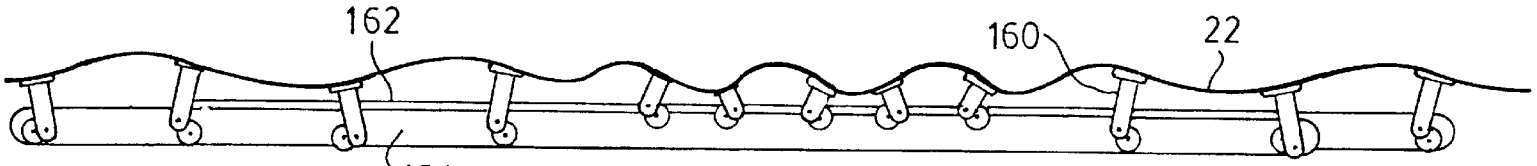
FIG. 13(*a*) is a side view of a wavegenerating apparatus for producing variable wavelength waves.
Figure 13B:
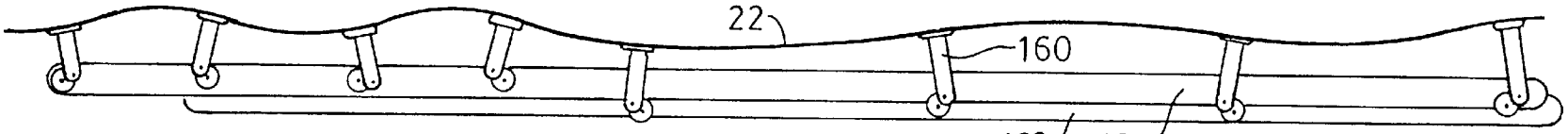

The length of drive rods 82, 84, 86, 88 and 90 determines the amount of angular displacement of the rod. It will be understood that the term drive rod and link member refer to the same components. The length of the drive rod or link is determined so that the resultant angle matches the tangential slope of the driven wave at any crank angle. The relationship between wavelength and drive rod length for constant amplitude is illustrated in FIGS. 13*a* and 13*b* with drive rods or link members 160 connecting flexible sheet 22 to beams 162 and 164. In FIG. 13(*a*) the wavelength decreases in direct proportion to decreasing length of the drive rods 160 and the distance between the drive rods. In FIG. 13(*b*) the drive rods 160 lengthen as does the distance between the rods to create a wave of increasing wavelength in flexible sheet 22. This illustrates the relationship between wavelength and drive rod length with amplitude remaining constant. It also shows how a device with a varying wavelength along its length can be generated from a single mechanism. It also follows that the wave velocity slows down as the wavelength shortens and then speeds up again as the wavelength increases again, since with every turn of the crank the wave moves ahead by one wavelength, whatever the wavelength.

Therefore, travelling waves with preselected wavelengths and amplitude may be produced using the present apparatus by adjusting the length of the link members, the spacing between them on the beams and spatially interleaving the links on the different beams.

Figure 14:
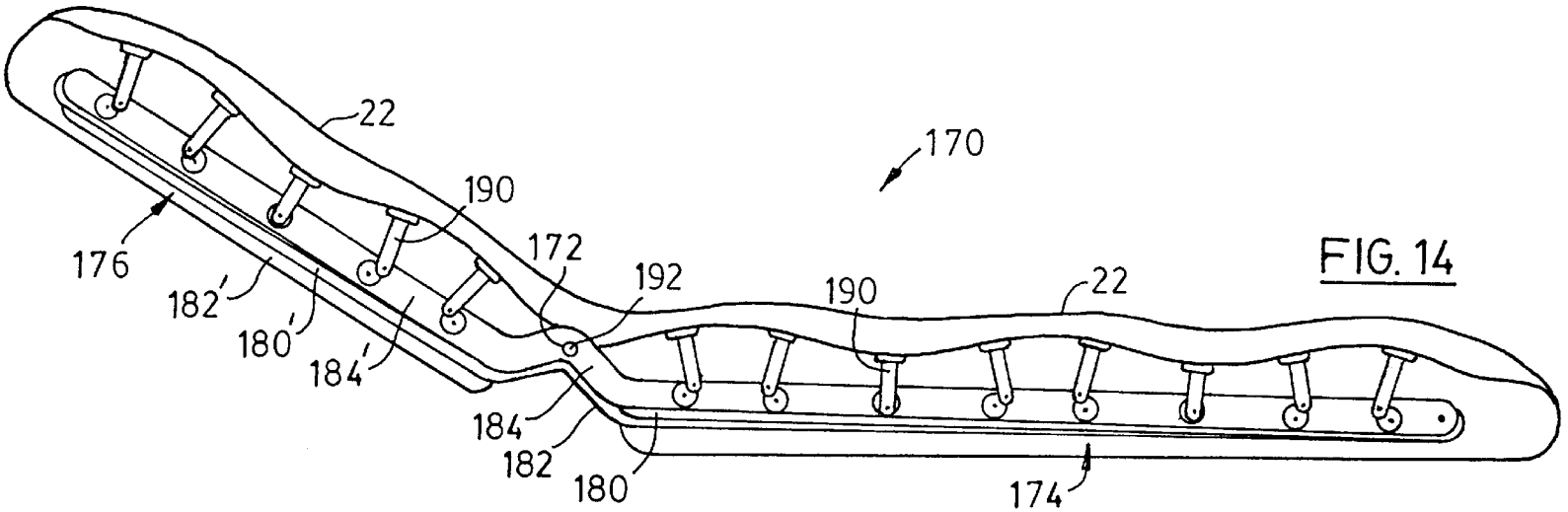
FIG. 14 is another embodiment of a wave bed constructed in accordance with the present invention.
Figure 15A:
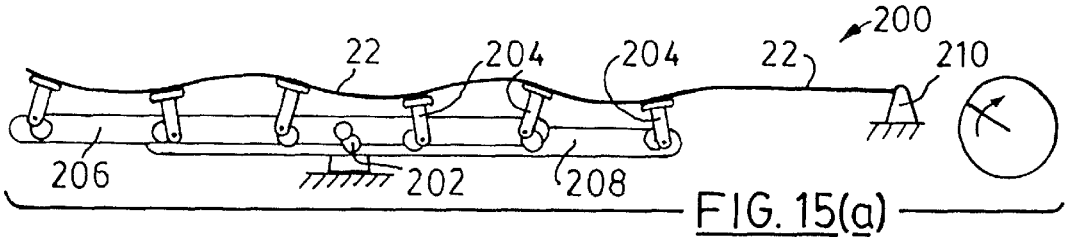
FIGS. 15(*a*) to 15(*f*) illustrate a dual beam wavegenerating apparatus.
Figure 15B:
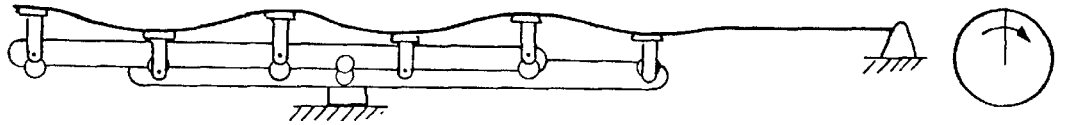
Figure 15C:
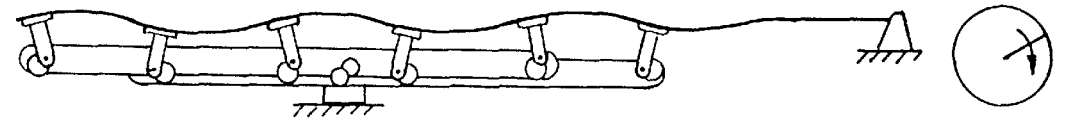
Figure 15D:
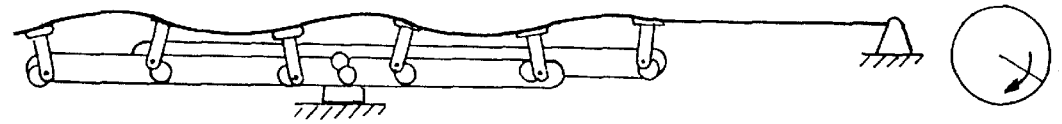
Figure 15E:
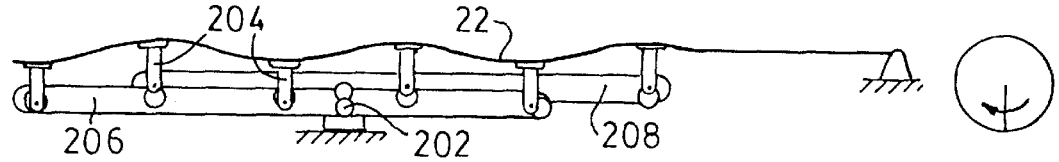
Figure 15F:
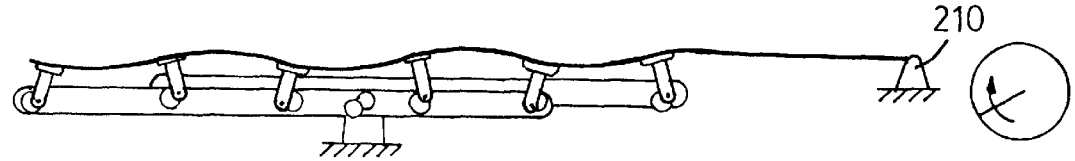

FIG. 14 shows an alternative embodiment of a wave bed with a crankshaft assembly 180, (similar in structure to crankshaft assembly 42 in FIG. 3) joining and transmitting power between two sets of beams 174 and 176. Set of beams 174 includes three beams 180, 182 and 184 respectively connected to beams 180', 182' and 184' in set 176. Flexible sheet 22 is connected by drive rods 190 to the respective beams. The axis 192 of the crankshaft 180 is located in the plane of the flexible sheet 22 so that flexing at the pivot point between the beams does not elongate the sheet. The beams and drive rods are also located on the two sides of the flexible sheet so that the hinge and beams do not interfere with the flexible sheet. Alternatively the mechanism can be upside down as shown in the side sketch allowing for a more compact packaging. This embodiment allows a single drive means on any crank to transmit power through (multiple) hinged joints and a flexible sheet that not only propagates a wave along its length, but also flexes around hinge points. This can be important in a wave bed since the hinges could allow for the bed to hinge upward as a back support as is required on hospital beds, as illustrated in the sketch or on a reclining chair, etc. FIG. 4*a* shows the second bar that pivots on a common crank in a 6-beam mechanism. In the 3-beam mechanism, the crank pins are 120 degrees apart rather than 60 degrees as shown.

This progression of FIGS. 15(*a*) to 15(*f*) illustrate a dual beam system at 200 comprising a single crank shaft 202 and three drive rods 204 connecting each of beams 206 and 208 to flexible sheet 22. It will be understood that the simplest possible wavegenerating apparatus according to the present invention would have only two drive rods on each beam. The progression illustrated from FIGS. 15(*a*) to 15(*f*) shows the crank angle advancing 60 degrees between consecutive Figures, with the wave advancing one full wavelength through the entire progression back to the start point. The flexible sheet 22 is attached at 21 thereby constraining it from moving horizontally so that it can only move vertically. The beams rotate in a circular arc transmitting a vertical deflection on the flexible sheet as well as imparting a slope equal to the correct tangential angle of the sinusoidal wave surface. It is because each drive rod imparts two constraints (vertical deflection as well as slope) to the flexible sheet 22 that a wave can be generated with a minimum of moving parts, optimum mechanical efficiency, and least mechanical complexity.

Figures 16, 17:
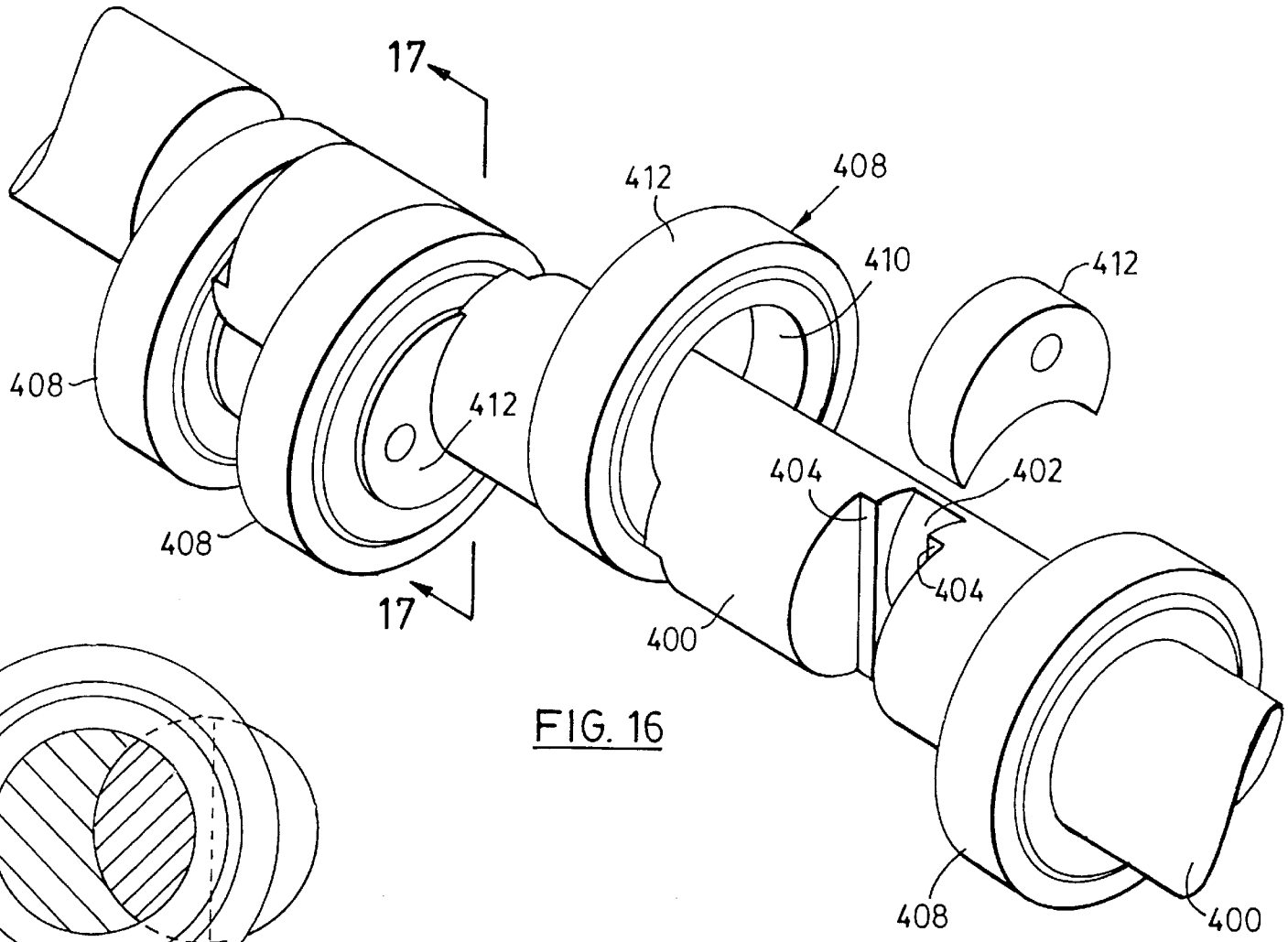
FIG. 16 is a perspective view, broken away, of a crankshaft assembly used for generating wave motion according to the present invention.
FIG. 17 is a cross sectional view taken along the line 17—17 in FIG. 16.

FIGS. 16,17, 18(*a*) and 18(*b*) illustrate a preferred embodiment of a c rank shaft assembly for a four beam bank with a 90° phase difference between each of the beams in the bank. Referring specifically to FIGS. 16 and 17, a section of a crankshaft 400 is shown with four slotted sections cut out of the shaft. Each slotted cut-out section includes a curved slotted portion 402 and two straight shoulder sections 404 on either side of the curved section 402. A cylindrical bearing assembly 408 with an inner cylindrical section 410 and an outer cylindrical section 412 sits in each slotted section with a portion of the curved surface of inner section 410 of the bearing assembly seated on the curved section 402 machined to have a matching curvature. The bearing assembly 408 is maintained in this position on the shaft 400 by the crescent shaped retainers 412 being inserted between the shaft and the inner curved surface of section 410. The shaft shown in FIG. 16 is used in a four beam bank so the bearings are rotationally displaced from adjacent bearings by a 90° phase difference to give a total of 360°.

Figures 18A, 18B:
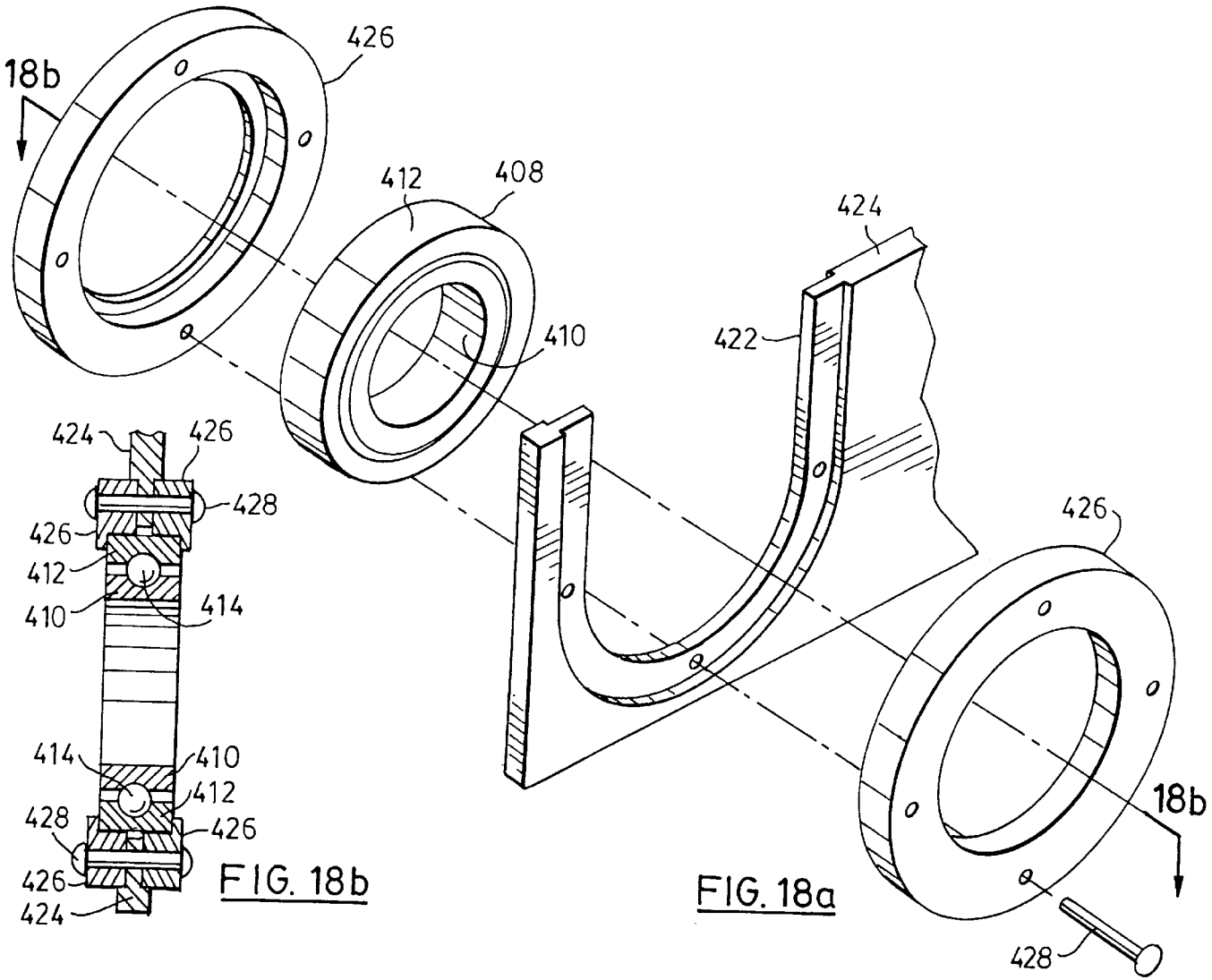
FIG. 18(*a*) is a perspective view of a cylindrical bearing and retaining plates used in the crankshaft assembly of FIG. 16.

Referring to FIGS. 18*a* and 18*b* the end of beam 420 has a cut-out section 422 and bearing 408 is held in the cut-out section by being clamped between two retaining discs 426 by fasteners 428 through holes in discs 426 and the beam. With the bearing 408 attached to the shaft 400 (FIG. 16) and coupled to beam 424, when the motor drives shaft 400 (FIG. 16) the shaft and inner cylindrical portion 410 rotates over bearings 414 with respect to the outer section 412 driving each beam in a circular orbit about the centre of the bearing attached to the beam with each beams being 90° out of phase with the preceding beam.

Figure 19:
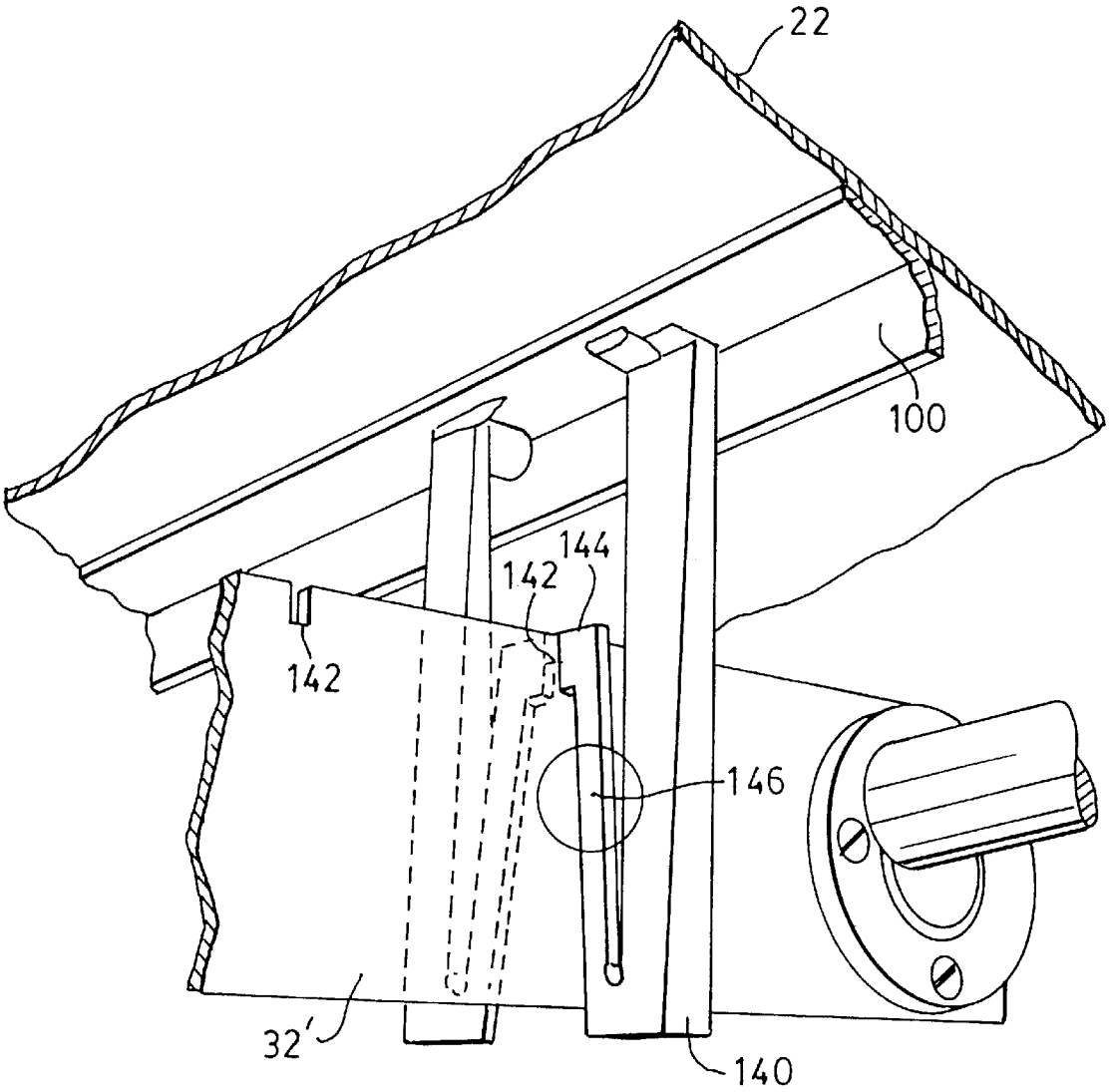
FIG. 19 is a perspective view, broken away, of an alternative embodiment of a connector for connecting a flexible sheet to a beam forming part of the present invention.

While the wave generating apparatus for generating waves in beds, chairs and the like has been described and illustrated with respect to the preferred embodiments, it will be appreciated by those skilled in the art that numerous variations of the invention may be made which still fall within the scope of the invention described herein. For example, because the drive rods only pivot through a small angle, they may be replaced with flexible springs rather than rigid rods pivotally connected to the beams. This further simplifies the design and reduces the part count. Referring to FIG. 19, the beams 32' are attached to ribs 100 by flexible spring members 140 thereby connecting the beams to flexible sheets 22. Slots 142 are cut out of the beam and a bracket section 144 of spring member 140 is inserted into the grove to form a friction fit thereby connecting the beam spring member to the beam. In operation the as the beams are driven the springs 140 flex and the beams essentially pivot about the circled region 146.

Figure 20:
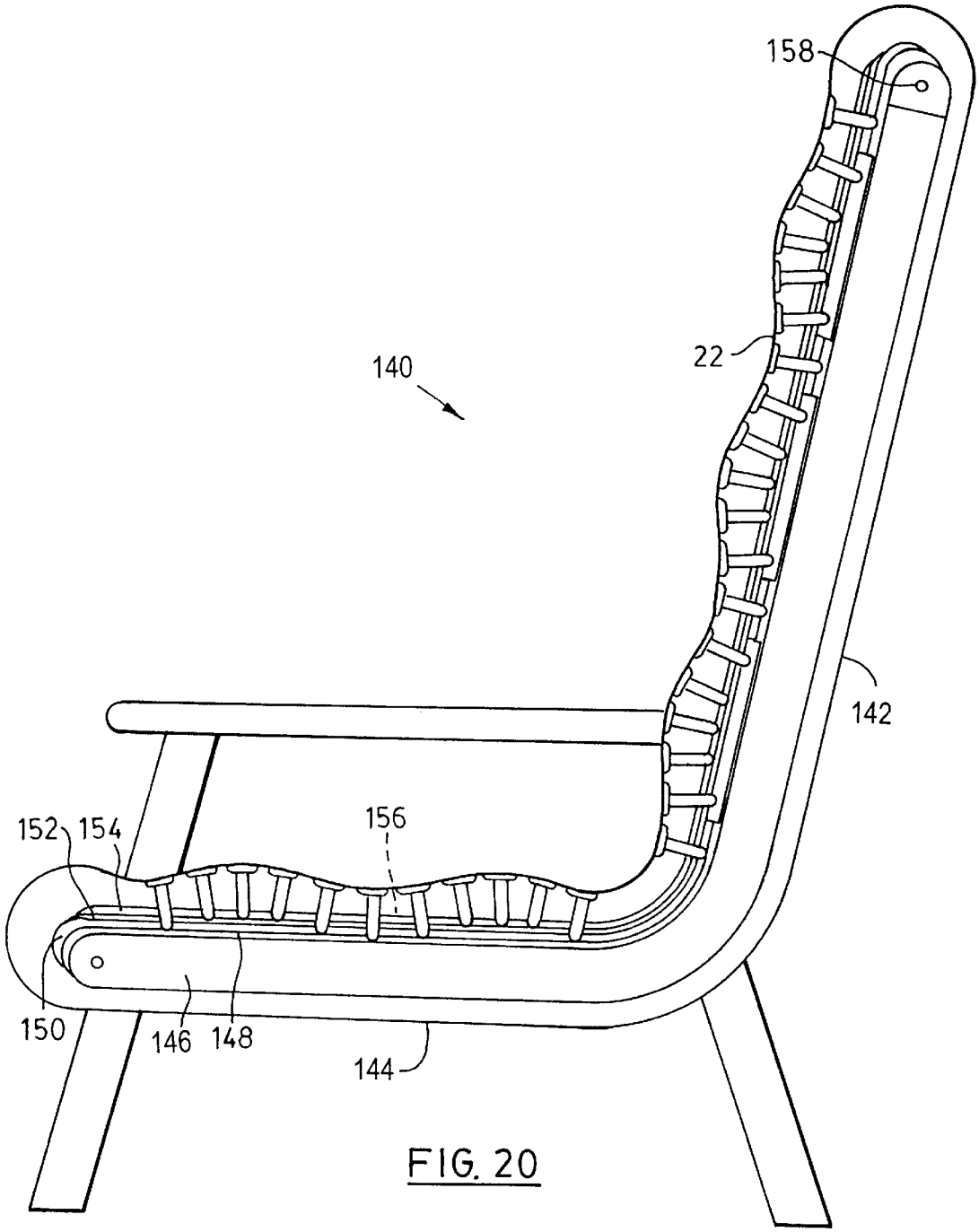
FIG. 20 is a cross sectional side elevation view of a wave chair produced in accordance with the present invention.

Referring to FIG. 20, a wave chair constructed in accordance with the present invention is shown generally at 140 having a back rest portion 142 and a seat portion 144. The beams 146, 148, 150, 152, 154 and 156 are generally L-shaped to provide back rest portion 142 and seat portion 144 with the beams being driven by a drive mechanism 158 similar to the mechanism 42 shown in FIG. 4, because each point in each beam still undergoes circular motion (regardless of its shape) a travelling wave is produced down the back rest and along the seat portion of chair 150.

It will be understood by those skilled in the art that only two beams are required to generate wave motion, however, three beams are necessary to impart rotary movement between the motor driven crank shaft and the idler crankshaft. A two beam mechanism has a point of instability when both the beams are aligned. In that position further rotation of the drive crank will not necessarily cause any rotation of the idler crankshaft. When the two beam system is aligned at the point of instability, the mechanism may lock up or the idler crank may counter-rotate. In a system with at least three beams the beams are never all aligned hence there is no point of instability.

Figure 21A:
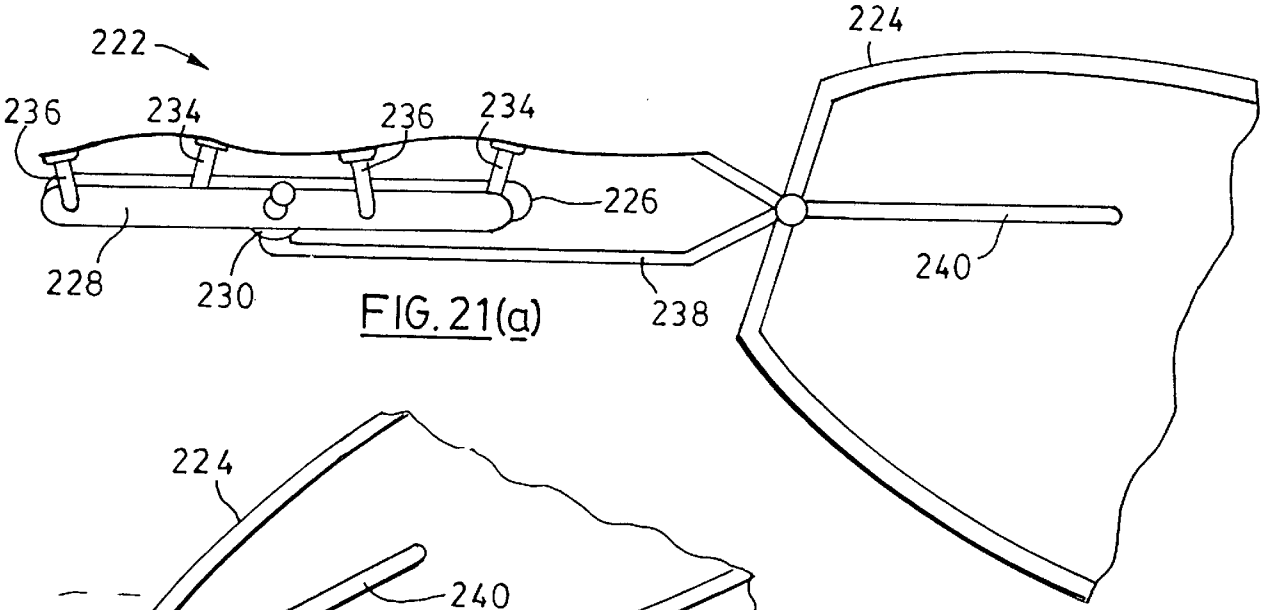
FIG. 21(*a*) is a plan view, broken away, of a boat and wavegenerating device as a rudder.
Figure 21B:
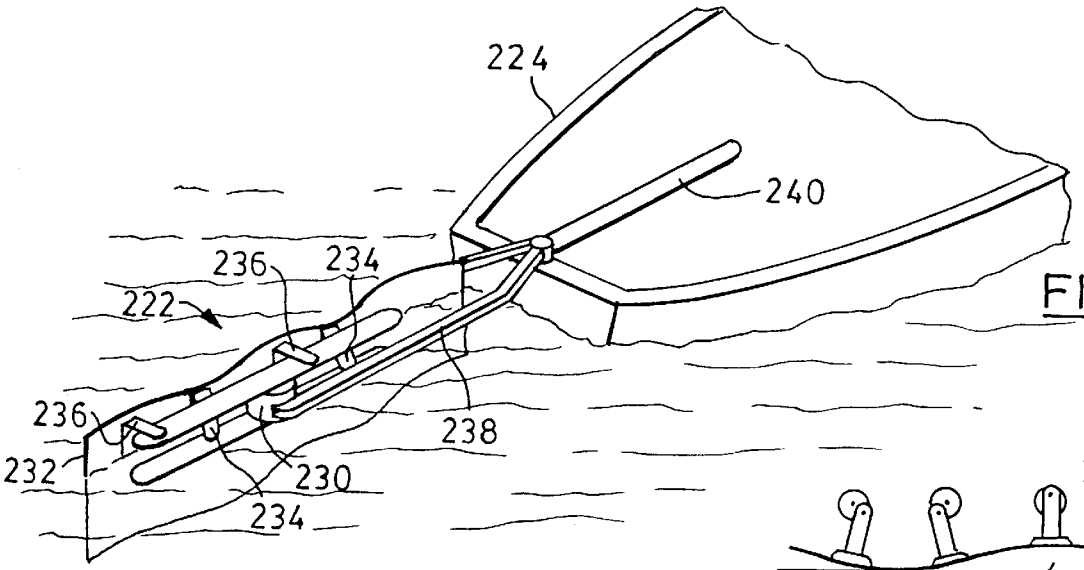

FIGS. 21(*a*) and 21(*b*) show the wavegenerating mechanism of the present invention being used to construct a self-propelling rudder 222 for a propulsion system for a boat 224. The self-propelling rudder comprises two beams 226 and 228 with a drive motor and crankshaft assembly 230 driving the two beams and producing sinusoidal wave motion on flexible sheet 232 connected to the beam 226 by at least two drive rods 234 and connected to beam 228 by at least two drive rods 236. A motor mounting beam 238 is connected to boat 224 for supporting the motor and crank assembly. Most of the flexible sheet 232 is submerged in the water and also acts as a rudder with the rudder 222 pivotally connected to boat 224 at 238 and hand operated by a tiller 240. The motor/crankshaft mechanism 230 is located above the water line so that only the thin flexible sheet 232 are immersed in order to minimize drag. Applications include all those in which propellers are used in water, air or other media.

A system with a single crank is underconstrained in that the shape of the wave is not necessarily sinusoidal since the beams are not forced into a parallel alignment. By pushing down on one end of the flexible sheet, the other end lifts and the wave distorts. This can be an advantage in the case of a propulsion system based on the present wavegenerating device. In a propulsion system the wave takes on a shape of least resistance to the water so that more of the wave energy goes directly into propulsion. This produces a wave motion that is more fishlike.

Figure 22:
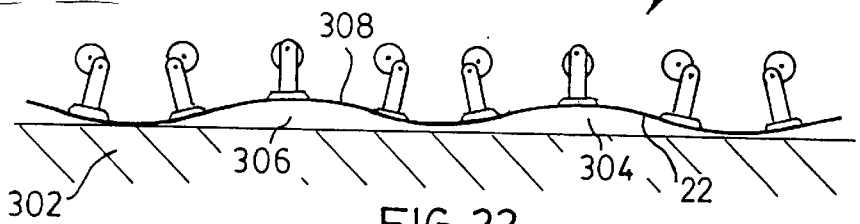
FIG. 22 shows a wave generating device adjacent a rigid surface.

FIG. 22 shows a wavegenerating device 300 adjacent to a rigid surface 302 so that when the device is operating the cavities 304, 306 formed between the flexible membrane 308 and the flat surface moves with the wave. In this configuration the system acts like a peristaltic pump. When combined with the feature of FIGS. 13(*a*) and 13(*b*), the volume of cavities 304 and 306 can be varied along the wave path, thereby compressing or decompressing the fluid as in an air compressor or vacuum pump. This system is vastly simpler, more effective and versatile than present pumping systems.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

Therefore what is claimed is:

1. An apparatus for converting rotary motion into wave motion and vice versa, comprising;

a) a frame, a crank assembly mounted on said frame, the crank assembly having an axis of rotation and being rotatable about said axis of rotation;

b) at least two elongate beams, each elongate beam having at least one crank attachment position radially offset from said axis of rotation and being attached to said crank assembly at said crank attachment position, said crank attachment positions on said at least two beams being offset from each other by a preselected angular displacement, wherein when said crank assembly is rotated each beam undergoes oscillatory motion in a plane;

c) each beam including at least two link members each pivotally connected at a first end portion thereof to the beam and spaced from each other a preselected distance along said beam; and d) a planar flexible member, said link members being attached at a second opposed end portion thereof to said planar flexible member, whereby when said crank assembly is rotated travelling waves are produced in the planar flexible member.

2. The apparatus according to claim 1 wherein each link member pivots substantially in the plane of oscillatory motion of the beam to which it is pivotally and wherein each plane is substantially perpendicular to said axis of rotation.

3. The apparatus according to claim 2 wherein said crank assembly includes at least a drive means for rotating said crank assembly clockwise or counterclockwise, and wherein when said crank assembly is rotated clockwise travelling waves are produced in said planar flexible member in one direction and when said crank assembly is rotated counterclockwise travelling waves are produced in said planar flexible member in the opposite direction.

4. The apparatus according to claim 3 wherein said link members each have an effective length and the link members on any one beam are positioned relative to the links on all remaining beams in a preselected interleaved spatial configuration to produce a travelling wave of preselected wavelength and amplitude.

5. The apparatus according to claim 4 wherein the length of the link members and the distance between the link members are preselectively varied to produce travelling waves of varying wavelength.

6. The apparatus according to claim 4 including at least one idler crank assembly having an axis of rotation and mounted on said frame spaced from said crank assembly, each beam having at least one idler crank attachment position offset from said axis of rotation and being attached to said crank assembly at said idler crank attachment position, and wherein each beam undergoes circular motion when said crank assembly is rotated.

7. The apparatus according to claim 6 wherein all of said link members have substantially the same length, and wherein said link members on one beam are interleaved at substantially equal phase intervals with respect to link members on all remaining beams to produce a substantially sinusoidal travelling wave of constant amplitude.

8. The apparatus according to claim 4 wherein said at least two elongate beams is two elongate beams.

9. The apparatus according to claim 8 including a motor mounted on said frame and connected to said crank assembly, said frame adapted for being connected to a tiller attachable to a boat, and wherein said flexible member depends downwardly from said beams whereby when said apparatus is connected to a boat a portion of said planar flexible membrane is located below a surface of a body of water, whereby travelling waves produced along said planar flexible member portion under the surface of a body of water provides propulsion.

10. The apparatus according to claim 9 wherein said crank attachment position on each beam is substantially midway along each beam.

11. The apparatus according to claim 4 wherein said at least two elongate beams is at least three elongate beams, including at least one idler crank assembly having an axis of rotation and mounted on said frame spaced from said crank assembly, each beam having at least one idler crank attachment position offset from said axis of rotation and being attached to said crank assembly at said idler crank attachment position.

12. The apparatus according to claim 11 wherein all of said link members have substantially the same length, and wherein said link members on one beam are interleaved at substantially equal phase intervals with respect to link members on all remaining beams to produce a substantially sinusoidal travelling wave of constant amplitude.

13. The apparatus according to claim 11 wherein the length of the link members and the distance between the link members are preselectively varied to produce travelling waves of varying wavelength.

14. The apparatus according to claim 11 wherein said planar flexible member including a top surface and a bottom surface, a plurality of rigid support panels attached to said bottom surface, each of said link members being attached at said second end portion to said rigid support panels.

15. The apparatus according to claim 14 wherein said frame is a bed frame, and wherein said flexible support member has a suitable size so that a user can recline on said top surface, and wherein a motor is connected to said crank assembly.

16. The apparatus according to claim 15 wherein said crank attachment position is located at an end portion of said elongate beams.

17. The apparatus according to claim 15 wherein said idler crank attachment position is located at an opposed end portion of said elongate beams.

18. The apparatus according to claim 14 wherein said frame is a chair frame, and wherein each of said beams includes at least a first beam member and a second beam member pivotally connected together, all of said pivotal connections between said first and second sections being side by side along a line perpendicular to a longitudinal axis of each beam, all of said first beam members defining a first support section and all of said second beam members defining a second support section, the first support section being pivotally movable with respect to the second support section.

19. The apparatus according to claim 18 wherein said crank attachment position is located at a free end portion of said first elongate beam members spaced from said pivotal connection.

20. The apparatus according to claim 19 where in said idler crank attachment position is located at a free end portion of said second elongate beam members spaced from said pivotal connection.

21. The apparatus according to claim 2 wherein said link members are flexible spring connectors.

22. The apparatus according to claim 2 including a generator connected to said crank assembly, and wherein when a force is applied to said flexible support member to produce wave motion in said flexible support member the crank assembly is rotated and said generator is driven.

23. A n apparatus for generating power from wave motion, comprising;

a) a frame, a crank assembly mounted on said frame, the crank assembly having an axis of rotation and being rotatable about said axis of rotation, and a generator connected to said crank assembly;

b) at least two elongate beams, each elongate beam having at least one crank attachment position radially offset from said axis of rotation and being attached to said crank assembly at said crank attachment position, said crank attachment positions on said at least two beams being offset from each other by a preselected angular displacement, wherein when said crank assembly is rotated each beam undergoes oscillatory motion in a plane;

c) each beam including at least two spaced link members each pivotally connected at a first end portion thereof to the beam and being pivotally movable substantially in the plane; and d) a planar flexible membrane, said link members being attached at a second opposed end portion thereof to said planar flexible membrane, and wherein when a force is applied to said flexible membrane wave motion is produced in said flexible membrane thereby rotating the crank assembly and driving said generator.

24. The apparatus according to claim 23 wherein each of said link members has an effective length and the link members on any one beam are positioned relative to the links on all remaining beams in a preselected interleaved spatial configuration.

25. An apparatus for converting rotary motion into wave motion and vice versa, comprising;

a) a frame, a crank assembly mounted on said frame, the crank assembly having an axis of rotation and being rotatable about said axis of rotation;

b) at least two elongate beams, each elongate beam having at least one crank attachment position radially offset from said axis of rotation and being attached to said crank assembly at said crank attachment position, said crank attachment positions on said at least two beams being offset from each other by a preselected angular displacement, wherein when said crank assembly is rotated each beam undergoes oscillatory motion in a plane;

c) each beam including at least two spaced link members each pivotally connected at a first end portion thereof to the beam and being pivotally movable substantially in the plane, each of said link members having an effective length and the link members on any one beam are positioned relative to the links on all remaining beams in a preselected interleaved spatial configuration; and d) a planar flexible membrane, said link members being attached at a second opposed end portion thereof to said planar flexible membrane, whereby when said crank assembly is rotated a travelling wave of preselected wavelength and amplitude is produced in the planar flexible membrane.

26. The apparatus according to claim 25 including at least one idler crank assembly having an axis of rotation and mounted on said frame spaced from said crank assembly, each beam having at least one idler crank attachment position offset from said axis of rotation and being attached to said crank assembly at said idler crank attachment position, and wherein said plane is substantially perpendicular to said axis of rotation.

27. The apparatus according to claim 26 wherein the length of the link members and the distance between the link members are preselectively varied to produce travelling waves of varying wavelength in said planar flexible membrane.

28. The apparatus according to claim 25 wherein a direction of rotation of said crank assembly produces travelling waves in a first direction and reversing direction of rotation of said crank assembly reverses direction of said travelling waves.

* * * * *